US009911307B1

(12) United States Patent
Goolsby

(10) Patent No.: US 9,911,307 B1
(45) Date of Patent: Mar. 6, 2018

(54) WATER LEAK ALARM ASSEMBLY

(71) Applicant: Phillip Goolsby, Equality, AL (US)

(72) Inventor: Phillip Goolsby, Equality, AL (US)

( * ) Notice: Subject to any disclaimer, the term of this patent is extended or adjusted under 35 U.S.C. 154(b) by 0 days.

(21) Appl. No.: 15/651,962

(22) Filed: Jul. 17, 2017

(51) Int. Cl.
*G08B 21/18* (2006.01)
*G08B 3/10* (2006.01)
*E03D 11/00* (2006.01)

(52) U.S. Cl.
CPC ..... *G08B 21/182* (2013.01); *E03D 11/00* (2013.01); *G08B 3/10* (2013.01)

(58) Field of Classification Search
CPC ..... G08B 21/182; G08B 3/10; E30D 11/00; G01M 3/26; G01M 3/2807
See application file for complete search history.

(56) References Cited

U.S. PATENT DOCUMENTS

D364,577 S 11/1995 Moore
8,310,369 B1 11/2012 Canfield et al.
8,844,067 B2 9/2014 Quintana et al.
2002/0033759 A1 3/2002 Morello
2004/0199989 A1 10/2004 Trolio
2005/0275546 A1 12/2005 McKenna et al.
2008/0309503 A1* 12/2008 White ..... G01M 3/26 340/606
2009/0224927 A1 9/2009 Sudy et al.

FOREIGN PATENT DOCUMENTS

WO WO2012116150 8/2012

* cited by examiner

*Primary Examiner* — Curtis Odom

(57) ABSTRACT

A water leak alarm assembly for identifying a water leak in a toilet includes a first housing that is mounted to a tank of a toilet. An alert unit is positioned within the first housing and the alert unit selectively generates an audible alarm. A second housing is provided and the second housing is positioned on a fluid supply line on the toilet. A detection unit is positioned within the second housing to detect the sound of water flowing through the fluid supply line. The detection unit is electrically coupled to the alert unit. The alert unit emits the audible alarm when the detection unit detects the sound of water flowing through the fluid supply line for a duration of time that exceeds a trigger duration of time.

11 Claims, 4 Drawing Sheets

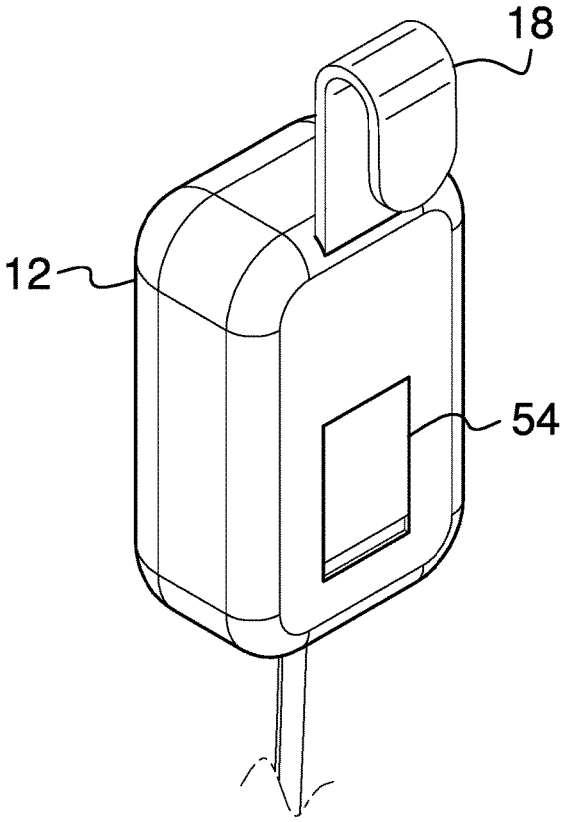
FIG. 3
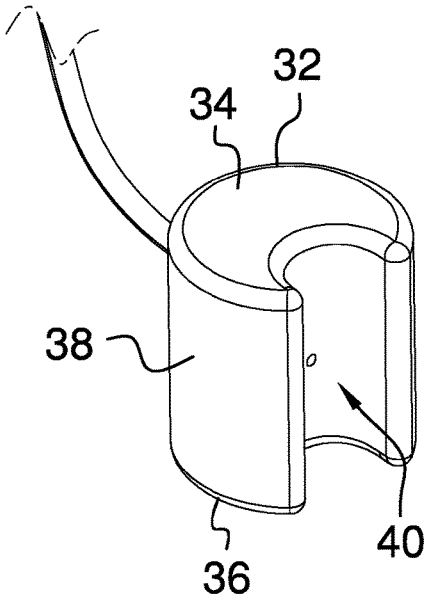

WATER LEAK ALARM ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to alarm devices and more particularly pertains to a new alarm device for identifying a water leak in a toilet.

BRIEF SUMMARY OF THE INVENTION

An embodiment of the disclosure meets the needs presented above by generally comprising a first housing that is mounted to a tank of a toilet. An alert unit is positioned within the first housing and the alert unit selectively generates an audible alarm. A second housing is provided and the second housing is positioned on a fluid supply line on the toilet. A detection unit is positioned within the second housing to detect the sound of water flowing through the fluid supply line. The detection unit is electrically coupled to the alert unit. The alert unit emits the audible alarm when the detection unit detects the sound of water flowing through the fluid supply line for a duration of time that exceeds a trigger duration of time.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein:

FIG. 3 is a back perspective view of an embodiment of the disclosure.

DETAILED DESCRIPTION OF THE INVENTION

Figure 1:
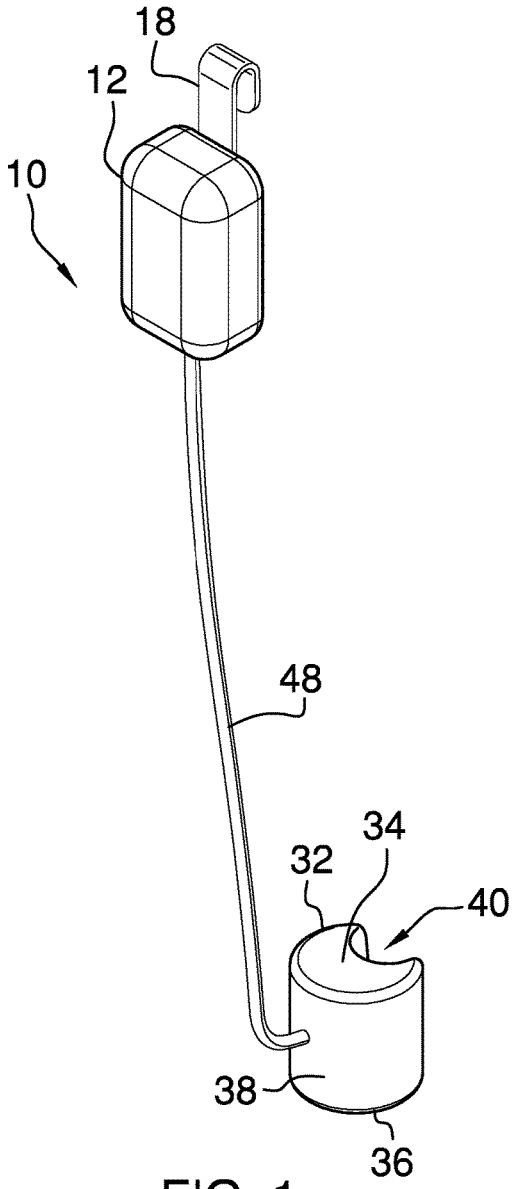
FIG. 1 is a perspective view of a water leak alarm assembly according to an embodiment of the disclosure.
Figure 2:
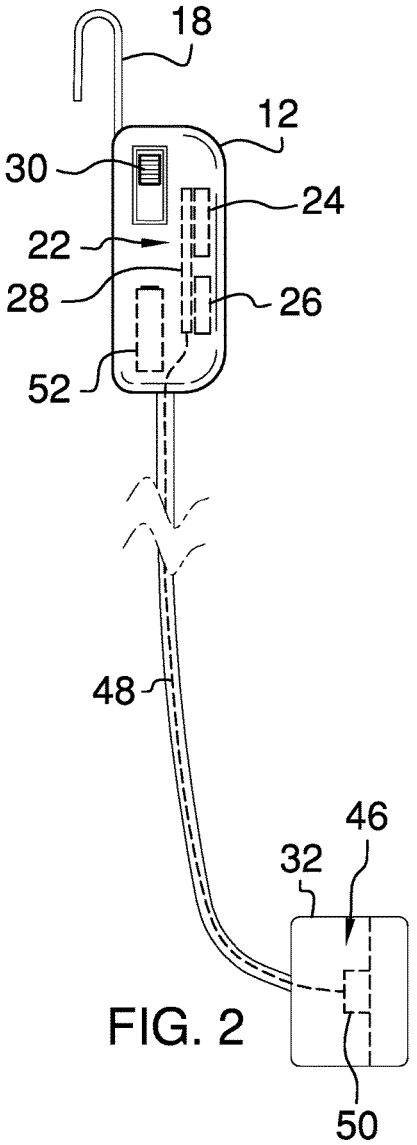
FIG. 2 is a phantom view of an embodiment of the disclosure.
Figure 4:
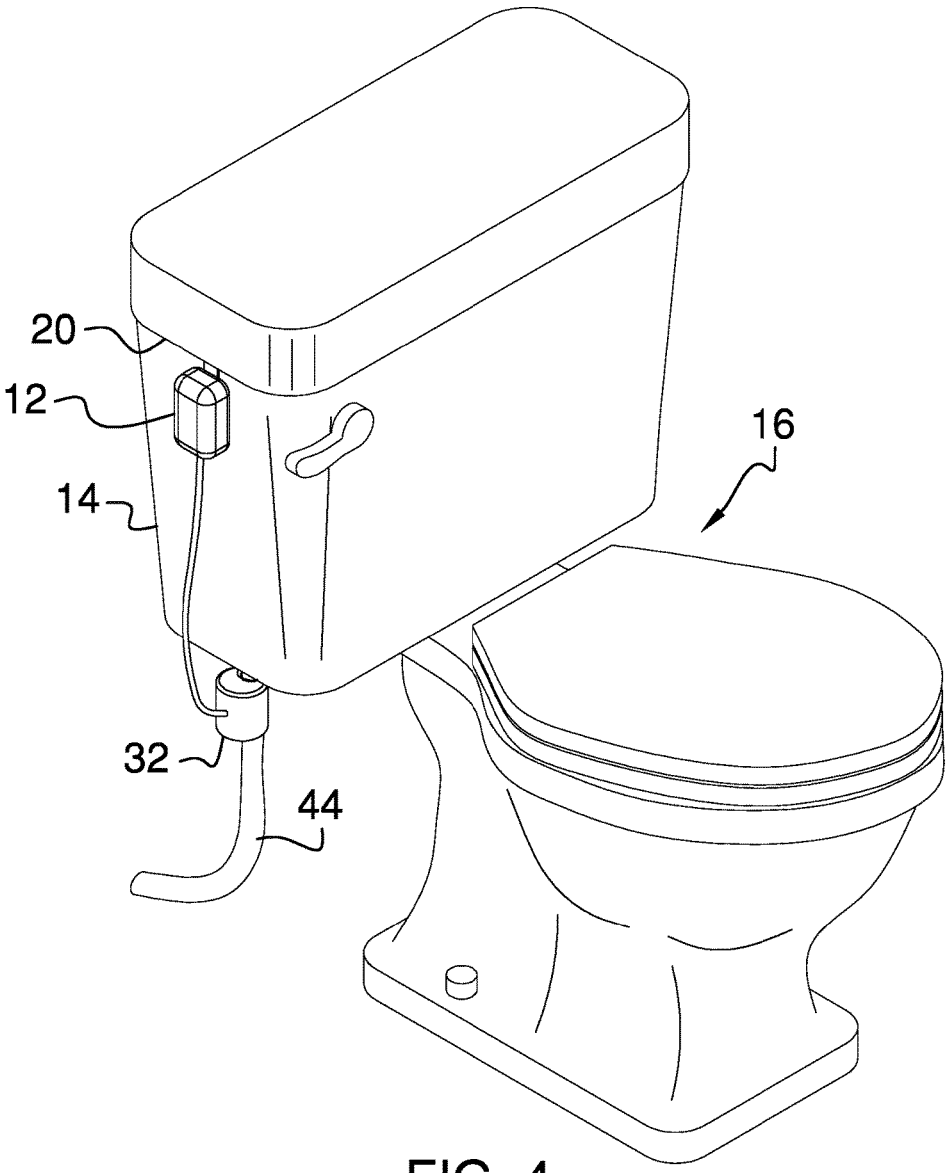
FIG. 4 is a perspective in-use view of an embodiment of the disclosure.
Figure 5:
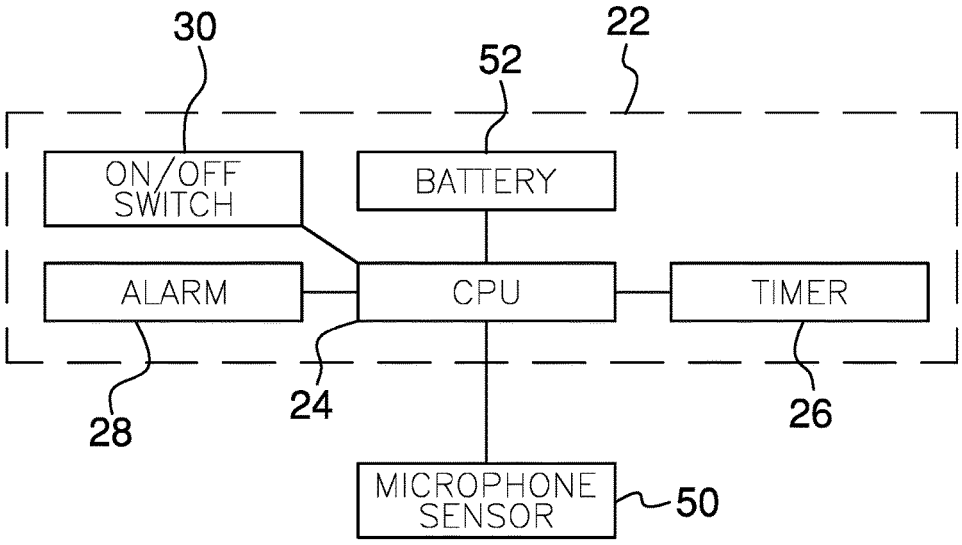
FIG. 5 is a schematic view of an embodiment of the disclosure.

With reference now to the drawings, and in particular to FIGS. 1 through 5 thereof, a new alarm device embodying the principles and concepts of an embodiment of the disclosure and generally designated by the reference numeral 10 will be described.

As best illustrated in FIGS. 1 through 5, the water leak alarm assembly 10 generally comprises a first housing 12 that may be mounted to a tank 14 of a toilet 16. A hook 18 is coupled to the first housing 12 and the hook 18 engages an upper edge 20 of the tank 14 thereby suspending the first housing 12 on the tank 14. An alert unit 22 is positioned within the first housing 12 and the alert unit 22 selectively generates an audible alarm 28.

The alert unit 22 comprises a processor 24 that is positioned within the first housing 12. The processor 24 selectively generates the alert sequence and the processor 24 may be an electronic processor or the like. A timer 26 is positioned within the first housing 12 and the timer 26 is electrically coupled to the processor 24. The timer 26 may comprise an electronic timer or the like.

An alarm 28 is coupled to the first housing 12 and the alarm 28 selectively emits an audible alert outwardly from the first housing 12. The alarm 28 is electrically coupled to the processor 24 and the alarm 28 is turned on when the processor 24 generates the alert sequence. The alarm 28 may comprise an electronic speaker or the like. A switch 30 is slidably coupled to the first housing 12 and the switch 30 is selectively manipulated. The switch 30 is electrically coupled to the processor 24 such that the switch 30 turns the processor 24 on and off.

A second housing 32 is provided that has a top wall 34, a bottom wall 36 and an outer wall 38 extending therebetween. The outer wall 38 is continuous such that the second housing 32 has a cylindrical shape. The outer wall 38 has a channel 40 extending inwardly therein and the channel 40 extends between the top 34 and bottom 36 walls. The channel 40 has a bounding surface 42 and the bounding surface 42 is concavely arcuate with respect to the outer wall 38. In this way the channel 40 may conform to a fluid supply line 44 on the toilet 16.

A detection unit 46 is positioned within the second housing 32 and the detection unit 46 detects the sound of water flowing through the fluid supply line 44. The detection unit 46 is electrically coupled to the alert unit 22. Moreover, the alert unit 22 emits the audible alarm when the detection unit 46 detects the sound of water flowing through the fluid supply line 44 for a duration of time that exceeds a trigger duration of time. In this way each of the detection 46 and alert 22 units notify a user of a potential water leak in the toilet 16.

The detection unit 46 comprises a conductor 48 that is coupled between the first housing 12 and the top wall 34 of the second housing 32. In this way the second housing 32 is suspended from the first housing 12. The conductor 48 is electrically coupled to the processor 24. The conductor 48 may be insulated with a non-conductive, fluid impermeable sheath such as rubber or the like.

A microphone 50 is positioned within the second housing 32 and the microphone 50 detects audible sound. The microphone 50 is electrically coupled to the conductor 48 such that the microphone 50 is in electrical communication with the processor 24. Moreover, the microphone 50 is positioned on the bounding surface 42 of the channel 40. In this way the microphone 50 detects the sound of water flowing through the fluid supply line 44. The microphone 50 may be an electronic microphone or the like.

A power supply 52 is removably positioned within the first housing 12. The power supply 52 is electrically coupled to the processor 24 and the power supply 52 comprises at least one battery. A battery cover 54 is removably coupled to the first housing 12. The power supply 52 is positioned beneath the battery cover 54 to facilitate the at least one battery to be replaced.

In use, the hook 18 is manipulated to engage the top edge of the toilet 16 and the second housing 32 is positioned on the fluid supply line 44. The timer 26 is actuated into a detection sequence when the switch 30 is manipulated to turn the processor 24 on. The toilet 16 is flushed immediately after the switch 30 is manipulated to turn the processor 24 on. The timer 26 counts a duration of time that the microphone 50 detects the sound of water flowing through the fluid supply line 44 when the toilet 16 is flushed to establish a trigger time.

When the trigger time is established, the processor 24 generates the alert sequence when the microphone 50 detects the sound of water flowing through the fluid supply line 44 for a duration of time that exceeds the trigger time. In this way the alarm 28 notifies the user that water is flowing through the fluid supply line 44 when the water should not be flowing thereby facilitating the user to remedy a potential malfunction with the toilet 16. Additionally, the toilet 16 may be fluidly coupled to a septic tank and the alarm 28 reduces the likelihood that the malfunctioning toilet 16 will fill the septic tank too quickly.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A water leak alarm assembly being configured to be mounted on a toilet thereby facilitating said assembly to generate an audible alarm when said assembly detects a water leak, said assembly comprising:

a first housing being configured to be mounted to a tank of a toilet;

an alert unit being positioned within said first housing, said alert unit selectively generating an audible alarm;

a second housing being configured to conform to a fluid supply line on the toilet; and a detection unit being positioned within said second housing wherein said detection unit is configured to detect the sound of water flowing through the fluid supply line, said detection unit being electrically coupled to said alert unit, said alert unit emitting said audible alarm when said detection unit detects the sound of water flowing through the fluid supply line for a duration of time that exceeds a trigger duration of time.

2. The assembly according to claim 1, wherein said alert unit comprises a processor being positioned within said first housing, said processor selectively generating an alert sequence.

3. The assembly according to claim 2, further comprising a timer being positioned within said first housing, said timer being electrically coupled to said processor.

4. The assembly according to claim 2, further comprising an alarm being coupled to said first housing wherein said alarm is configured to emit an audible alert outwardly from said first housing, said alarm being electrically coupled to said processor, said alarm being turned on when said processor generates said alert sequence.

5. The assembly according to claim 2, further comprising a switch being slidably coupled to said first housing wherein said switch is configured to be manipulated, said switch being electrically coupled to said processor such that said switch turns said processor on and off.

6. The assembly according to claim 1, wherein said second housing has a top wall, a bottom wall and an outer wall extending therebetween, said outer wall being continuous such that said second housing has a cylindrical shape, said outer wall having a channel extending inwardly therein, said channel extending between said top and bottom walls, said channel having a bounding surface, said bounding surface being concavely arcuate with respect to said outer wall.

7. The assembly according to claim 6, wherein said detection unit comprises a conductor being coupled between said first housing and said top wall of said second housing such that said second housing is suspended from said first housing, said conductor being electrically coupled to a processor.

8. The assembly according to claim 7, further comprising a microphone being positioned within said second housing wherein said microphone is configured to detect audible sound, said microphone being electrically coupled to said conductor such that said microphone is in electrical communication with said processor, said microphone being positioned on said bounding surface of said channel wherein said microphone is configured to detect the sound of water flowing through the fluid supply line.

9. The assembly according to claim 8, wherein said alert unit includes a timer, said timer counting a duration of time that said microphone detects the sound of water flowing through the fluid supply line when the toilet is flushed to establish a trigger time, said processor generating an alert sequence when said microphone detects the sound of water flowing through the fluid supply line for a duration of time that exceeds said trigger time.

10. The assembly according to claim 2, further comprising a power supply being removably positioned within said first housing, said power supply being electrically coupled to said processor, said power supply comprising at least one battery.

11. A water leak alarm assembly being configured to be mounted on a toilet thereby facilitating said assembly to generate an audible alarm when said assembly detects a water leak, said assembly comprising:

a first housing being configured to be mounted to a tank of a toilet;

a hook being coupled to said first housing wherein said hook is configured to engage an upper edge of the tank thereby suspending said first housing on the tank;

an alert unit being positioned within said first housing, said alert unit selectively generating an audible alarm, said alert unit comprising:

a processor being positioned within said first housing, said processor selectively generating an alert sequence, a timer being positioned within said first housing, said timer being electrically coupled to said processor, an alarm being coupled to said first housing wherein said alarm is configured to emit an audible alert outwardly from said first housing, said alarm being electrically coupled to said processor, said alarm being turned on when said processor generates said alert sequence, and a switch being slidably coupled to said first housing wherein said switch is configured to be manipulated, said switch being electrically coupled to said processor such that said switch turns said processor on and off, a second housing having a top wall, a bottom wall and an outer wall extending therebetween, said outer wall being continuous such that said second housing has a cylindrical shape, said outer wall having a channel extending inwardly therein, said channel extending between said top and bottom walls, said channel having a bounding surface, said bounding surface being concavely arcuate with respect to said outer wall wherein said channel is configured to conform to a fluid supply line on the toilet; and a detection unit being positioned within said second housing wherein said detection unit is configured to detect the sound of water flowing through the fluid supply line, said detection unit being electrically coupled to said alert unit, said alert unit emitting said audible alarm when said detection unit detects the sound of water flowing through the fluid supply line for a duration of time that exceeds a trigger duration of time, said detection unit comprising:

a conductor being coupled between said first housing and said top wall of said second housing such that said second housing is suspended from said first housing, said conductor being electrically coupled to said processor, a microphone being positioned within said second housing wherein said microphone is configured to detect audible sound, said microphone being electrically coupled to said conductor such that said microphone is in electrical communication with said processor, said microphone being positioned on said bounding surface of said channel wherein said microphone is configured to detect the sound of water flowing through the fluid supply line, said timer counting a duration of time that said microphone detects the sound of water flowing through the fluid supply line when the toilet is flushed to establish a trigger time, said processor generating said alert sequence when said microphone detects the sound of water flowing through the fluid supply line for a duration of time that exceeds said trigger time, and a power supply being removably positioned within said first housing, said power supply being electrically coupled to said processor, said power supply comprising at least one battery.

* * * * *